US008576043B2

(12) United States Patent
Liu et al.

(10) Patent No.: US 8,576,043 B2
(45) Date of Patent: Nov. 5, 2013

(54) SURFACE-MOUNT TYPE OVERCURRENT PROTECTION ELEMENT

(75) Inventors: Zhengping Liu, Shanghai (CN); Yutang Liu, Shanghai (CN); Jun Wang, Shanghai (CN); Jinhua Yang, Shanghai (CN); Daohua Gao, Shanghai (CN); Zhen Cheng, Shanghai (CN); Quantao Li, Shanghai (CN); Tianju Sun, Shanghai (CN)

(73) Assignee: Shanghai Changyuan Wayon Circuit Protection Co., Ltd., Shanghai (CN)

( * ) Notice: Subject to any disclaimer, the term of this patent is extended or adjusted under 35 U.S.C. 154(b) by 0 days.

(21) Appl. No.: 13/519,990

(22) PCT Filed: Mar. 10, 2010

(86) PCT No.: PCT/CN2010/070957

§ 371 (c)(1),
(2), (4) Date: Oct. 2, 2012

(87) PCT Pub. No.: WO2011/079549

PCT Pub. Date: Jul. 7, 2011

(65) Prior Publication Data

US 2013/0015943 A1 Jan. 17, 2013

(30) Foreign Application Priority Data

Dec. 31, 2009 (CN) ..... 2009 1 0248045

(51) Int. Cl.
*H01C 7/10* (2006.01)

(52) U.S. Cl.
USPC ..... 338/22 R; 338/13; 29/610.1

(58) Field of Classification Search
USPC ..... 338/22 R, 13, 20, 25; 29/610.1
See application file for complete search history.

(56) References Cited

U.S. PATENT DOCUMENTS

| | | | | |
|---|---|---|---|---|
| 5,347,258 | A * | 9/1994 | Howard et al. | 338/333 |
| 5,852,397 | A * | 12/1998 | Chan et al. | 338/22 R |
| 5,900,800 | A * | 5/1999 | McGuire et al. | 338/22 R |
| 6,236,302 | B1 * | 5/2001 | Barrett et al. | 338/22 R |
| 7,026,583 | B2 * | 4/2006 | Tu et al. | 219/541 |
| 7,701,322 | B2 | 4/2010 | Wang | |
| 2006/0055501 | A1 | 3/2006 | Burke | |
| 2009/0224865 | A1 | 9/2009 | Tanaka | |

* cited by examiner

*Primary Examiner* — Kyung Lee

(57) ABSTRACT

A surface-mount type over-current protection element includes two single-layer composite chips, wherein one chip is made of a first core material and a first and a second metallic foil layer attached on the two surfaces of the first core material, the other chip is made of a second core material and a third and a fourth metallic foil layer attached to the two surfaces of the second core material. The protection element also has an insulating layer arranged between the two chips to electrically insulate and bond to the second and third metallic layers to form a bi-layer composite chip. Part of the first metallic foil layer and the corresponding part of the fourth metallic foil layer are etched to expose part of the first core material and correspond part of the second core material. One or more through-holes are made on the bi-layer composite chip for mounting.

9 Claims, 6 Drawing Sheets

SURFACE-MOUNT TYPE OVERCURRENT PROTECTION ELEMENT

FIELD OF THE INVENTION

The present invention relates to a surface-mount type over-current protection element, and more particularly to a over-current protection element with low resistance、subsize and positive thermal coefficient (PTC) behavior.

BACKGROUND OF THE INVENTION

It was apparent to us that the conductive polymer made of polymer and conductive filler material dispersed in the polymer, and the technique of manufacturing the conductive polymer into the over-current protection device with PTC behavior. Generally, PTC conductive polymer is made of a kind of or more kinds of crystalline polymer and a kind of conductive filler material and the conductive filler material dispersed in the polymer. The polymer can be a kind of or the mixture of more kinds of polyethylene、vinyl copolymer and fluoropolymer: The conductive filler material can be black carbon 、metal particles or inorganic ceramic powder. The PTC behavior of the conductive polymer the resistance value increase with the increasing of temperature) is considered to be due to the rupture of the conducting path, which is made of conducting particle because of the expansion of the liquating crystalline polymer.

Among the existing published technology, the general way is to use the black carbon as the conductive filler material. But the conductive polymer using the black carbon as the conductive filler material is too difficult to get a low room-temperature resistivity, particularly using the polymer to make the over-current protection device of batteries can't satisfy the requirements of the miniaturization (e.g. size 1210, and the device area is 0.12"×0.10", changing to the metric unit is 3.4 mm×2.75 mm) and the low resistance at room temperature (The typical resistance value of the zero power is 5 mΩ, and the resistance value is less than 15 mΩ after welded.). Nevertheless using the metal particles (e.g. nickel powder) as the conductive filler material can get conductive polymer of lower resistivity at room temperature. The over-current protection device made of the conductive polymer can satisfy the requirements of the miniaturization and the low room-temperature resistance. But there is a new problem: general metal powder is very easy to be oxidized, particularly the oxidizing reaction will speed up in hot environment, which is the cause of the increasing resistance of the device, and it will lead the device to the failure.

To this end, the present invention will publish a surface-mount type overcurrent protection element with subsize 、low resistance and good environmental stability.

SUMMARY OF THE INVENTION

It is an object of this invention to provide a surface-mount type over-current protection element with not only low resistance、subsize、high carrying current and PTC behavior but also good environmental stability.

The other object of the invention is to provide the manufacturing method of the surface mount over-current protection element.

The technical solution we present to solve the mentioned problems in this invention is to provide a surface mount over-current protection element, comprising: two single-layer PTC multiple chips, the chip is made up of the first PTC chip material、the first metal foil layer and the second metal foil layer, which are pasted on both surfaces of the first PTC chip material, the other chip is made up of the second PTC chip material、the third metal foil layer、the fourth metal foil layer, which are pasted on both upper and lower surfaces of the second PTC chip material, the first metal foil layer、the second metal foil layer、the third metal foil layer and the fourth metal foil layer are all single-sided coarsening copper foil, the coarsening side is pasted to the first PTC chip material or the second PTC chip material, comprising:

There is the third insulation layer between the two single-layer PTC multiple chips to insulate the second metal foil layer from the third metal foil layer and also bond them so as to constitute the double-layer PTC multiple chip;

There are the etching figures on the eccentric center position of the double-layer PTC multiple chip, on the relative position of both the first metal foil layer and the fourth metal foil layer to expose the first PTC chip material and the second PTC chip material so as to constitute the small multiple chip;

There is the isolating layer surrounding the double-layer PTC multiple chip the isolating layer so as to constitute the covered chip;

The first insulation layer and the second insulation layer are fitted on both upper and lower surfaces of the covered chip;

The first insulation layer insulate the first metal electrode and the third metal electrode, which are on both side of its upper surface, from the first metal foil layer and also bond them, moreover, there is a spacing between the first metal electrode and the third metal electrode to expose the first insulation layer;

The second insulation layer insulate the second metal electrode and the fourth metal electrode, which are on both side of its lower surface, from the fourth metal foil layer and also bond them, moreover, there is a spacing between the second metal electrode and the fourth metal electrode to expose the second insulation layer;

There are the copper plates plating on the surfaces of the first metal electrode、the third metal electrode、the second metal electrode and the fourth metal electrode;

There is the inner through hole at the etching figures, the inner through hole is concentric with the etching figures, and its inner diameter is shorter than the diameter of the etching figures;

There are the through-holes at both the end;

There are the blind holes on both upper and lower surfaces of the symmetrical position of the inner through hole to expose the first PTC chip material and the second PTC chip material;

There are metallic conductors being located on the inner surface of the inner through hole、the end through hole and the blind holes, among the metallic conductors, The first metallic conductor is located on the inner surface of the end through hole to connect up the first metal electrode and the second metal electrode;

The third metallic conductor is located on the inner surface of the end through hole to connect up the third metal electrode and the fourth metal electrode;

The second metallic conductor is located on the inner surface of the inner through hole to connect up the first metal electrode、the second metal foil layer、the third metal foil layer and the second metal electrode;

The fourth metallic conductor is located on the inner surface of the blind hole to connect up the third metal electrode and the first metal foil layer;

The fifth metallic conductor is located on the inner surface of the other blind hole, to connect up the fourth metal electrode and the fourth metal foil layer;

The fourth insulation layer insulates the first metal electrode from the third metal electrode and obstruct the portholes of the inner through hole and the blind hole;

The fifth insulation layer insulate the second metal electrode from the fourth metal electrode and obstruct the portholes of the inner through hole and the blind hole.

In addition to the above, there are tin plate plating on the surfaces of the first metal electrode、the third metal electrode、the second metal electrode、the fourth metal electrode and the inner surfaces of the end through hole.

Accordingly, The resistance at room temperature of the over-current protection device is less than 5 mΩ.

In addition to the above, The material of the first insulation layer、the second insulation layer and the third insulation layer is the complex of epoxy resin and glass fiber.

The isolating layer is an epoxy resin layer.

The manufacturing method of the surface-mount type over-current protection element, comprising:

The first step: Using the crystalline high polymer and the mixture of conductive metal powder and high polymer to manufacture the PTC chip material, and then pasting the metal foil layers on both upper and lower surfaces of the PTC chip material to make the single-layer PTC multiple chips, whose thickness are 0.35 mm±0.05 mm;

The second step: Putting the third insulation layer between two single-layer PTC multiple chips and pressing them into one chip, then doing irradiation crosslinking to get the double-layer PTC multiple chip;

The third step: There are the etching figures on the relative position of both the first metal foil layer and the fourth metal foil layer, and then cutting the layers according to the figures size to constitute the small multiple chip;

The fourth step: Choosing the isolating layer of the same thickness as the small multiple chip, and drilling the hole as the corresponding figure of the small multiple chip on the isolating layer, then inserting the small multiple chip into the hole of the isolating layer to constitute the covered chip;

The fifth step: Bonding the first insulation layer and the second insulation layer on both upper and lower surfaces of the covered chip, and then bonding the metal electrodes on both upper and lower surfaces of the first insulation layer and the second insulation layer;

The sixth step: Drilling, including drilling two end through hole at both the end, drilling the inner through hole through the etching figures, the inner diameter of the inner through hole is shorter than the diameter of the etching figures, drilling the blind holes on both upper and lower surfaces of the symmetrical position of the inner through hole to expose the first PTC chip material and the second PTC chip material;

The seventh step: Copper plating, including plating copper on surface of the metal electrodes to be the copper plate, plating copper on the inner surface of the inner through hole and the end through holes to be the second metallic conductor、the first metallic conductor and the third metallic conductor, plating copper on the inner surface of the blind hole to be the fourth metallic conductor and the fifth metallic conductor;

The eighth step: Etching, etching on both upper and lower surfaces of the copper plate to fall into the left part and the right part, copper plates and, etching the metal electrodes to fall into the left part and the right part, the first metal electrode、the third metal electrode、the second metal electrode and the fourth metal electrode, to expose the first insulation layer and the second insulation layer;

The ninth step: Printing a coat of solder resist ink on both upper and lower surfaces, having solidified to be the fourth insulation layer and the fifth insulation layer. The fourth insulation layer insulates the first metal electrode from the third metal electrode and obstructs the portholes of the inner through hole and the blind hole. The fifth insulation layer insulates the second metal electrode from the fourth metal electrode and obstructs the portholes of the inner through hole and the blind hole;

The tenth step: Plating tin on the surfaces of the first metal electrode、the third metal electrode、the second metal electrode、the fourth metal electrode and the inner surfaces of the end through hole to be the tin plate to composite the over-current protection device.

In addition to the above, The first PTC chip material and the second PTC chip material is mixed of poly-component, including a kind of the crystalline high polymer and a kind of conductive metal powder at least.

Accordingly, The crystalline high polymer is one of or more of the high density polyethylene、the low density polyethylene、vinyl copolymer、polyvinylidene fluoride; The conductive metal powder is one of or more of nickel powder、cobalt powder、copper powder、silver powder.

In addition to the above, The isolating layer is a single entity, there are many holes on it in equispace to be inserted by the small multiple chip, and there are the frameworks between the holes, drilling the end through hole on the frameworks, then cutting along the centerline of the frameworks to make many over-current protection devices.

The beneficial effects of the present invention are:

The surface-mount type over-current protection element of the present invention can apply to different sizes of the surface mount device. But volume resistivity of the over-current protection device can be less than 0.1 Ω·cm and the over-current protection device also can carry more than 0.5 A current in from 1 $mm^2$ because of using metal powder as the conducting particle of PTC material and the design of parallel connection and lamination for double layer PTC material. In a conclusion, the over-current protection device applies to mainly some smaller-sized surface mount devices (the size such as 1210、1206、0805). And the surface-mount type over-current protection element satisfies the requirements of the battery used for smart mobile phone such as high carrying current and subsize.

Because there are the isolating layers around PTC material of the surface-mount type over-current protection element of the present invention to isolate PTC material from the outside oxygen and moisture, so that the resistance value will not increase obviously with the increasing of temperature or after a long while, which proves good environmental stability.

| Mark number of the Drawings | | | |
|---|---|---|---|
| 10, 10' | the single-layer PTC multiple chips; | | |
| 20 | the double-layer PTC multiple chip; | | |
| 30 | the small multiple chip; | | |
| 40 | the covered chip; | | |
| 50 | a surface-mount type over-current protection element; | | |
| 11 | the first metal foil layer; | 12 | the first PTC material layer; |
| 13 | the second metal foil layer; | 14 | the third insulation layer; |
| 15 | the third metal foil layer; | 16 | the second PTC material layer; |
| 17 | the fourth metal foil layer; | 18, 19 | etching circles; |
| 21 | the isolating layer; | 22 | the square holes; |
| 23 | the first insulation layer; | 24 | the second insulation layer; |
| 25, 26 | metal electrodes; | | |
| 25a | the first metal electrode; | 25b | the third metal electrode; |
| 26a | the second metal electrode; | 26b | the fourth metal electrode; |
| 27, 28 | the blind holes; | 29 | the inner through hole; |
| 31, 32 | the end through holes; | 33, 34 | the copper plates |
| 33a, 33b | the copper plates; | 34a, 34b | the copper plates; |
| 35 | the fourth metallic conductor; | 36 | the fifth metallic conductor; |
| 37 | the second metallic conductor; | 38 | the first metallic conductor; |
| 39 | the third metallic conductor; | 41 | the fourth insulation layer; |
| 42 | the fifth insulation layer; | 43, 44 | the tin plates. |

DETAILED DESCRIPTION OF EMBODIMENTS OF THE INVENTION

Figure 1:
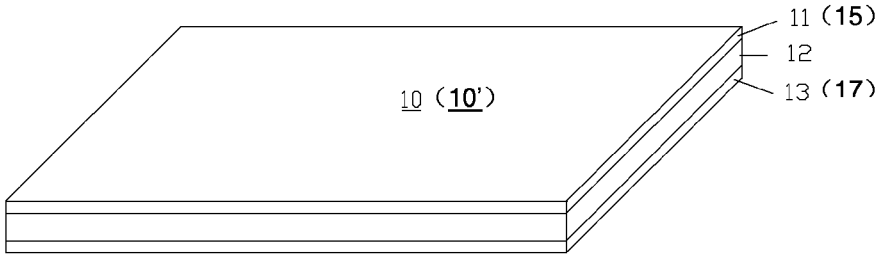
FIG. 1 illustrates the structure diagram of the single-layer PTC multiple chips.
Figure 2:
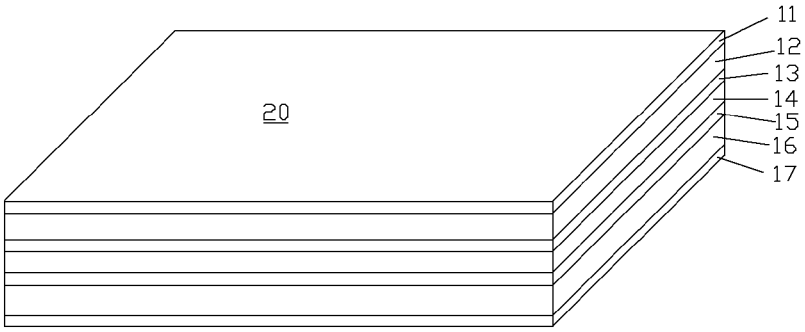
FIG. 2 illustrates the structure diagram of the double-layer PTC multiple chip.
Figure 3:
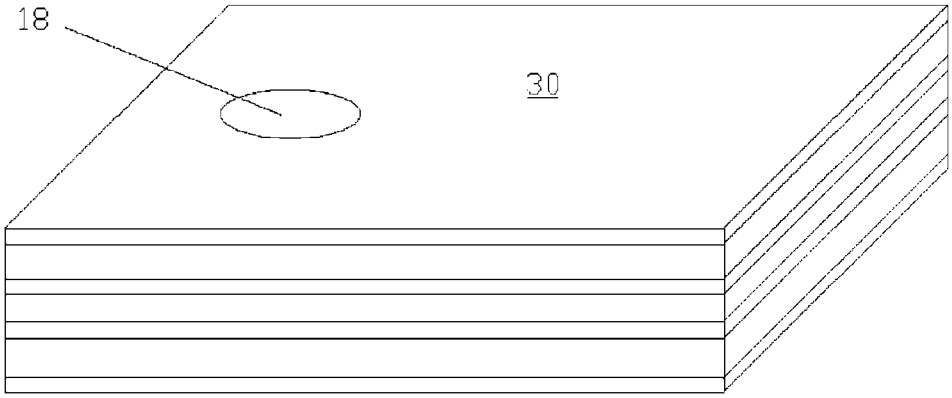
FIG. 3 illustrates the structure diagram of the small multiple chip.
Figure 4:
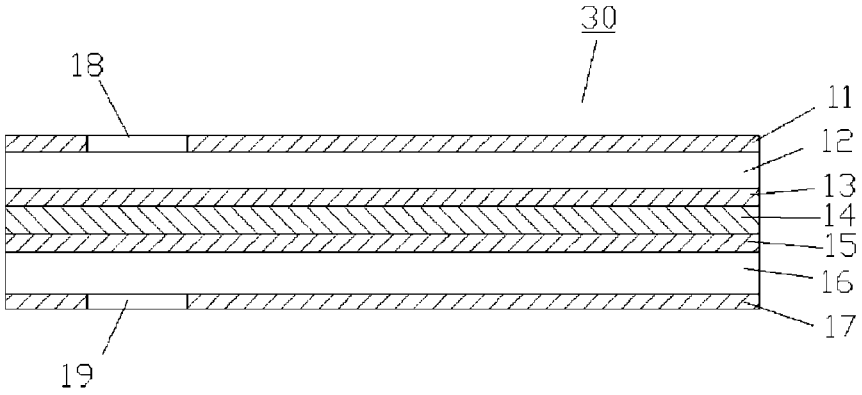
FIG. 4 illustrates the section structure diagram of FIG. 3.
Figure 5:
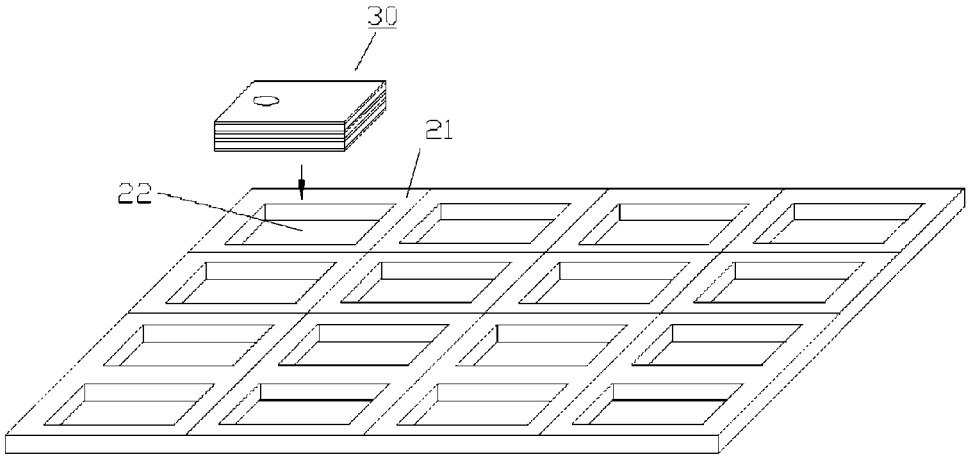
FIG. 5 illustrates the structure diagram of inserting the small multiple chip into the isolating layer.
Figure 6:
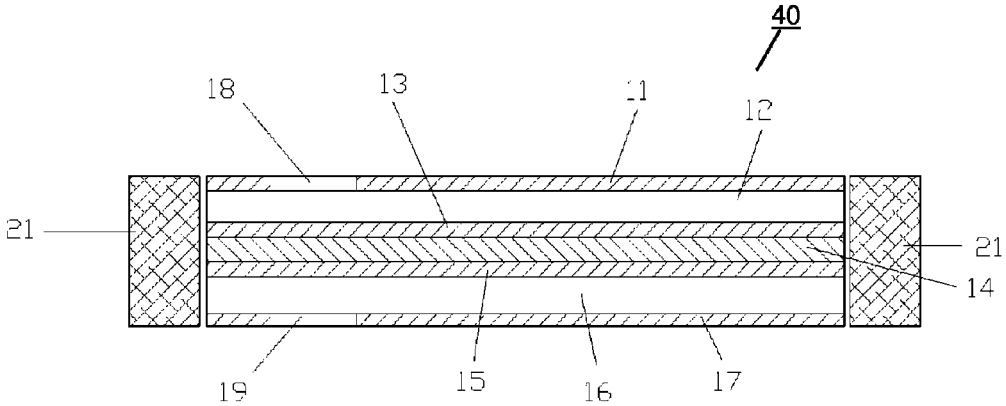
FIG. 6 illustrates the section structure diagram of the covered chip.
Figure 7:
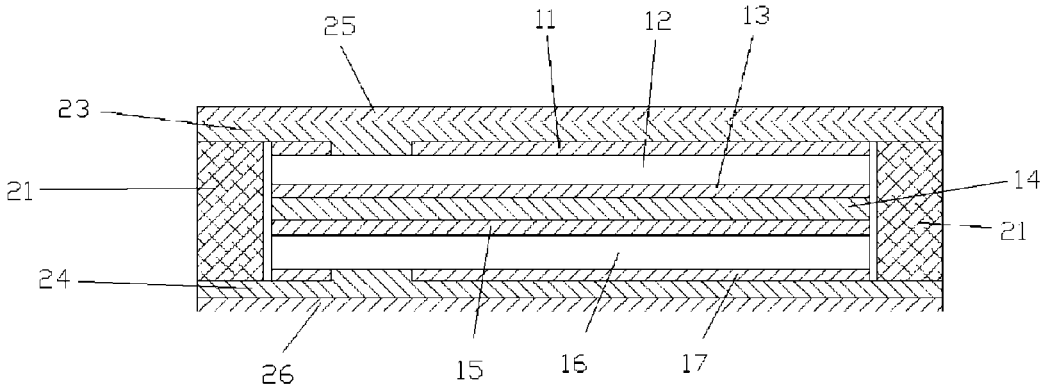
FIG. 7 illustrates the section structure diagram of having pasted the metal electrode on the insulation layer.
Figure 8:
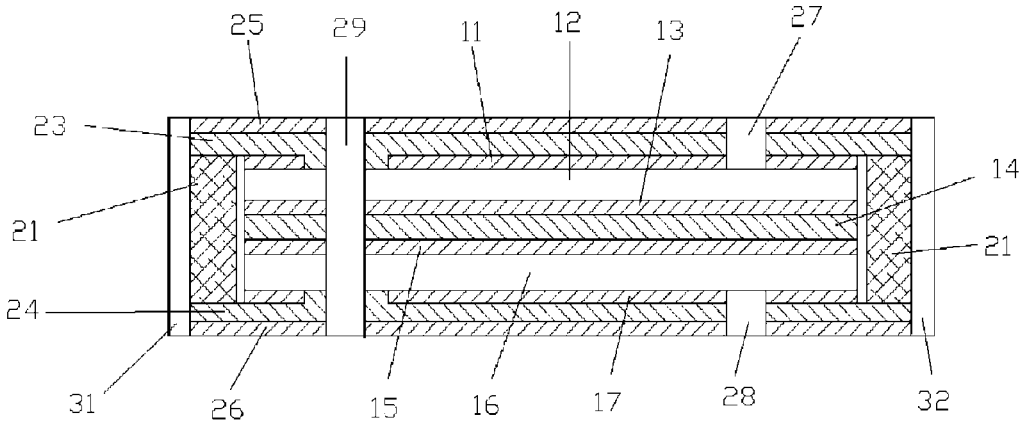
FIG. 8 illustrates the section structure diagram of having drilled the through holes and the blind holes.
Figure 9:
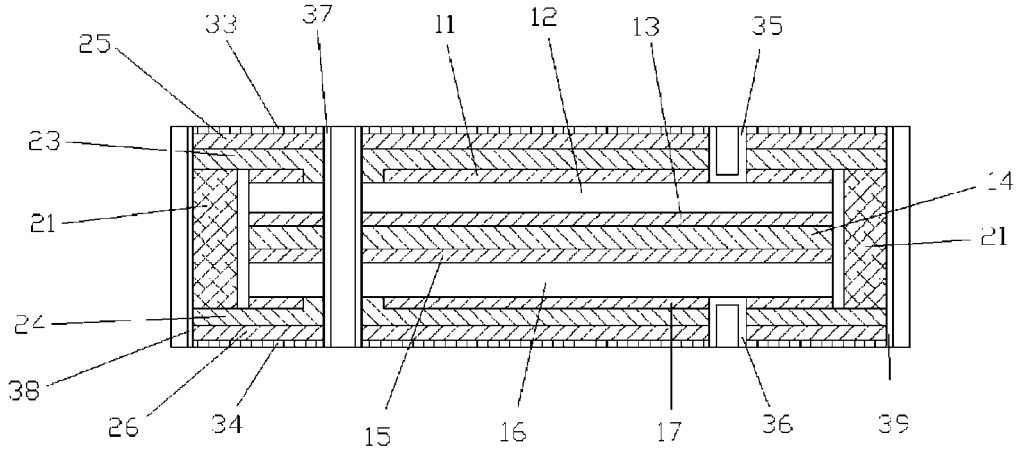
FIG. 9 illustrates the section structure diagram of having plated the copper plates.
Figure 10:
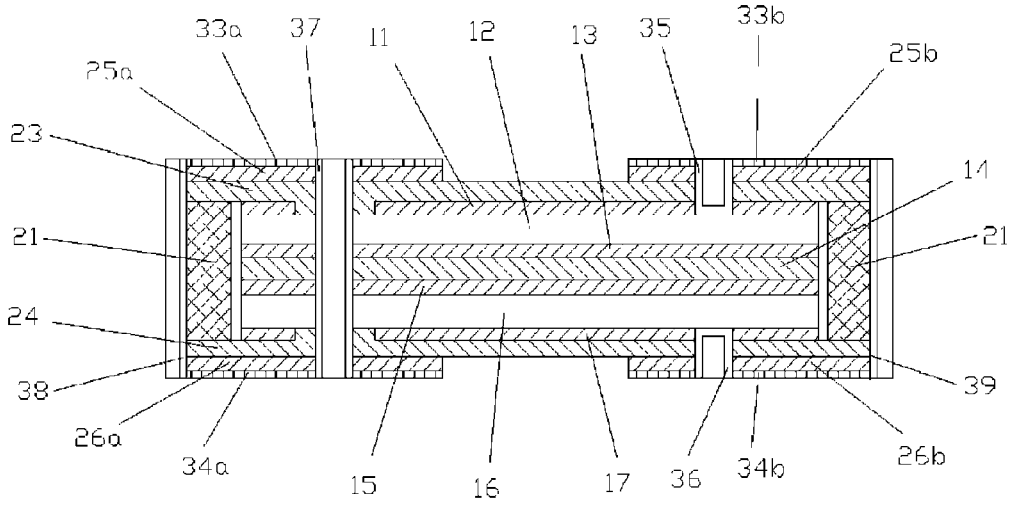
FIG. 10 illustrates the section structure diagram of having etched on the copper plates and the metal electrodes.
Figure 11:
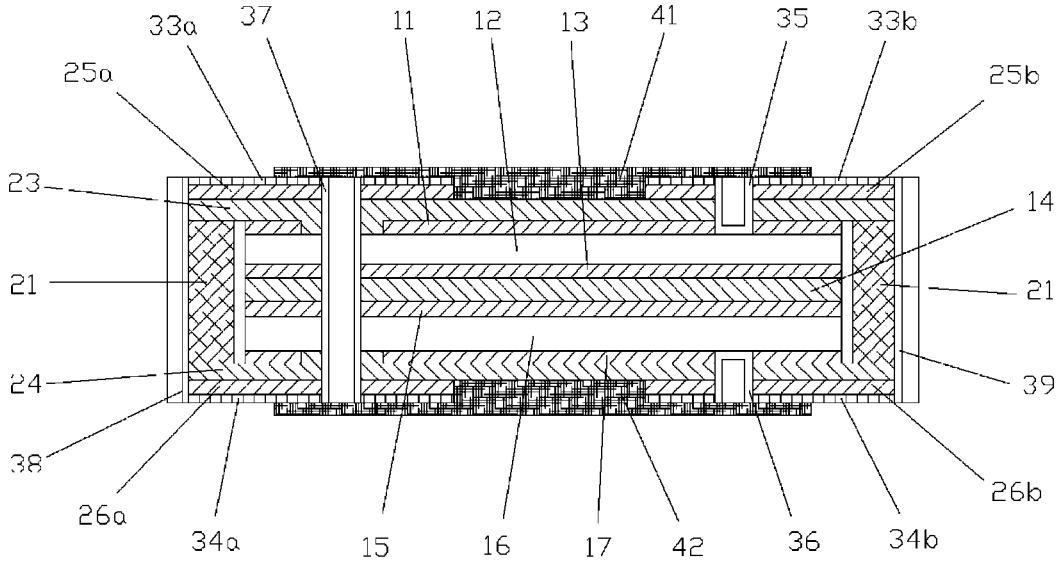
FIG. 11 illustrates the section structure diagram of having painted the insulation layer.
Figure 12:
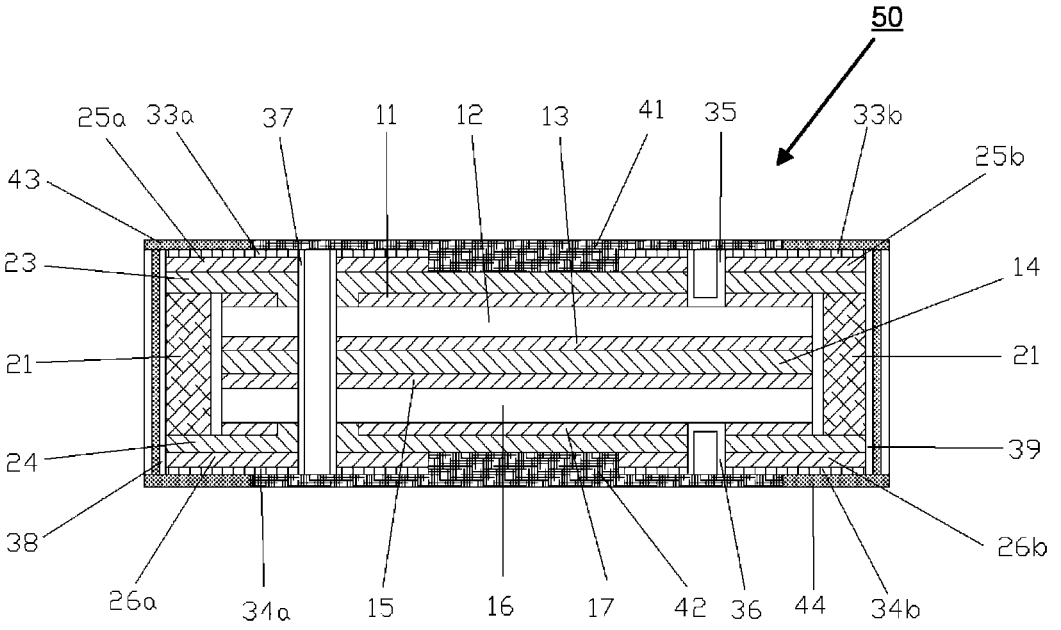
FIG. 12 illustrates the section structure diagram of the over-current protection device.

The manufacturing method of the surface-mount type over-current protection element, comprising:

The first step: Mixing 100 units high density polyethylene (BHB5012, Phillips fossil oil), 500 units nickel powder (CNP525, INCO), 30 units magnesium hydrate and 0.5 units processing aid well at 190 in the internal mixer, then pulling out the first PTC chip material 12 and the second PTC chip material 16 from the open mill, whose thickness are 0.35 min±0.05 mm. Pasting the first metal foil layer 11 and the second metal foil layer 13 on both upper and lower surfaces of the first PTC chip material 12 and pasting the third metal fail layer 15 and the fourth metal foil layer 17 on both upper and lower surfaces of the second PTC chip material 16, then press them into one chip to get the single-layer PTC multiple chips 10、10', whose thickness are 0.35 mm±0.05 mm. FIG. 1 illustrates the structure diagram of the single-layer PTC multiple chips;

The second step: Putting the third insulation layer 14 between two single-layer PTC multiple chips 10、10' and pressing them into one chip at 150 in the press, then doing irradiation crosslinking to get the double-layer PTC multiple chip 20. FIG. 2 illustrates the structure diagram of the double-layer PTC multiple chip;

The third step: There are the etching circle 18、19 on the relative position of both the first metal foil layer 11 and the fourth metal foil layer 17, and then die-cutting or cutting up the 1.8 mm×2.65 mm small multiple chip 30, which each has the etching circle 18、19 on both upper and lower surfaces. FIG. 3 illustrates the structure diagram of the small multiple chip and FIG. 4 illustrates the section structure diagram of FIG. 3;

The fourth step: Choosing the isolating layer 21 of the same thickness as the small multiple chip 30, and drilling square holes 22 as the corresponding figure of the small multiple chip 30 on the isolating layer 21, and there are the frameworks between the square holes 22, then inserting the small multiple chip 30 into the square holes 22 of the isolating layer 21 to constitute the covered chip 40. FIG. 5 illustrates the structure diagram of inserting the small multiple chip into the isolating layer and FIG. 6 illustrates the section structure diagram of the covered chip;

The fifth step: Bonding the first insulation layer 23 and the second insulation layer 24, which both have bond action and insulation action, on both upper and lower surfaces of the covered chip 40, and then bonding metal electrodes 25、26 on both upper and lower surfaces of the first insulation layer 23 and the second insulation layer 24. FIG. 7 illustrates the section structure diagram of having pasted the metal electrode on the insulation layer;

The sixth step: On the isolating layer 21, drilling two the end through holes 31、32 at both the end, drilling the inner through hole 29 through the etching circles 18、19, the inner diameter of the inner through hole 29 is shorter than the diameter of the etching circles 18、19, and drilling the blind holes 27、28 on both upper and lower surfaces of the symmetrical position of the inner through hole 29 to expose the first PTC chip material 12 and the second PTC chip material 16. FIG. 8 illustrates the section structure diagram of having drilled the through holes and the blind holes;

The seventh stop: Chemical copper plating and electric copper plating, including plating copper on surface of the metal electrodes 25、26 to be the copper plate 33、34, plating copper on the inner surface of the inner through hole 29 and the end through holes 31、32 to be the second metallic conductor 37、the first metallic conductor 38 and the third metallic conductor 39, plating copper on the inner surface of the blind holes 27、28 to be the fourth metallic conductor 35 and the fifth metallic conductor 36. FIG. 9 illustrates the section structure diagram of having plated the copper plates;

The eighth step: Etching, etching on both upper and lower surfaces of the copper plates 33、34 to fall into the left part and the right part, the copper plates 33*a*、33 *b*、34*a* and 34*b*, and then etching metal electrodes 25、26 to fall into the left pan and the right part, the first metal electrode 25*a*、the third metal electrode 25*b*、the second metal electrode 26*a* and the fourth metal electrode 26*b*, to expose the first insulation layer 23 和 the second insulation layer 24. FIG. 10 illustrates the section structure diagram of having etched on the copper plates and the metal electrodes;

The ninth step: Printing a coat of solder resist ink on both upper and lower surfaces, having solidified to be the fourth insulation layer 41 and the fifth insulation layer 42. The fourth insulation layer 41 insulates the first metal electrode 25*a* from the third metal electrode 25*b* and obstructs the portholes of the inner through hole 29 and the blind hole 27. The fifth insulation layer 51 insulates the second metal electrode 26*a* from the fourth metal electrode 26*b* and obstructs the portholes of the inner through hole 29 and the blind hole 28. FIG. 11 illustrates the section structure diagram of having painted the insulation layer;

The tenth step: Plating tin on the surfaces of the first metal electrode 25*a*、the third metal electrode 25*b*、the second metal electrode 25*b*、the fourth metal electrode 26*b* and the inner surfaces of the end through holes 31、32 be the tin plates 43、44 then cutting along the centerline of the isolating layer 21 to make many over-current protection device 50. FIG. 12 illustrates the section structure diagram of the over-current protection device.

What is claimed is:

1. A surface-mount type over-current protection element, comprising: two single-layer PTC multiple chips (10)、(10'), the chip (10) is made up of the first PTC chip material (12)、the first metal foil layer (11) and the second metal foil layer (13), which are pasted on both surfaces of the first PTC chip material (12), the other chip (10') is made up of the second PTC chip material (16)、the third metal foil layer (15)、the fourth metal foil layer (17), which are pasted on both upper and lower surfaces of the second PTC chip material (16), comprising:

There is the third insulation layer (14) between the two single-layer PTC multiple chips (10)、(10') to insulate the second metal foil layer (13) from the third metal foil layer (15) and also bond them so as to constitute the double-layer PTC multiple chip (20);

There are the etching figures (18)、(19) on the eccentric center position of the double-layer PTC multiple chip (20), on the relative position of both the first metal foil layer (11) and the fourth metal foil layer (17) to expose the first PTC chip material (12) and the second PTC chip material (16) so as to constitute the small multiple chip (30);

There is the isolating layer (21) surrounding the double-layer PTC multiple chip (20) the isolating layer (21) so as to constitute the covered chip (40):

The first insulation layer (23) and the second insulation layer (24) are fitted on both upper and lower surfaces of the covered chip (40):

The first insulation layer (23) insulate the first metal electrode (25*a*) and the third metal electrode (25*b*), which are on both side of its upper surface, from the first metal foil layer (11) and also bond them, moreover, there is a spacing between the first metal electrode (25*a*) and the third metal electrode (25*b*) to expose the first insulation layer (23):

The second insulation layer (24) insulate the second metal electrode (26*a*) and the fourth metal electrode (26*b*), which are on both side of its lower surface, from the fourth metal foil layer (17) and also bond them, moreover, there is a spacing between the second metal electrode (26*a*) and the fourth metal electrode (26*b*) to expose the second insulation layer (24);

There are the copper plates (33*a*)、(33*b*)、(34*a*)、(34*b*) plating on the surfaces of the first metal electrode (25*a*)、the third metal electrode (25*b*)、the second metal electrode (26*a*) and the fourth metal electrode (26*b*);

There is the inner through hole (29) at the etching figures (18)、(19), the inner through hole (29) is concentric with the etching figures (18) (19), and its inner diameter is shorter than the diameter of the etching figures (18)、(19);

There are the end through holes (31)、(32) at both the end;

There are the blind holes (27)、(28) on both upper and lower surfaces of the symmetrical position of the inner through hole (29) to expose the first PTC chip material (12) and the second PTC chip material (16);

There are metallic conductors being located on the inner surface of the inner through hole (29)、the end through hole (31)、(32) and the blind holes (27)、(28), among the metallic conductors, The first metallic conductor (38) is located on the inner surface of the end through hole (31) to connect up the first metal electrode (25*a*) and the second metal electrode (26*a*);

The third metallic conductor (39) is located on the inner surface of the end through hole (32) to connect up the third metal electrode (25*b*) and the fourth metal electrode (26*b*):

The second metallic conductor (37) is located on the inner surface of the inner through hole (29) to connect up the first metal electrode (25*a*)、the second metal foil layer (13)、the third metal foil layer (15) and the second metal electrode (26*a*);

The fourth metallic conductor (35) is located on the inner surface of the blind hole (27) to connect up the third metal electrode (25*b*) and the first metal foil layer (11);

The fifth metallic conductor (36) is located on the inner surface of the other blind hole (28), to connect up the fourth metal electrode (26*b*) and the fourth metal foil layer (17);

The fourth insulation layer (41) insulate the first metal electrode (25*a*) from the third metal electrode (25*b*) and obstruct the portholes of the inner through hole (29) and the blind hole (27);

The fifth insulation laver (42) insulate the second metal electrode (26*a*)from the fourth metal electrode (26*b*) and obstruct the portholes of the inner through hole (29) and the blind hole (28).

2. The surface-mount type over-current protection element of claim 1, comprising:

There are tin plate (43)、(44) plating on the surfaces of the first metal electrode (25*a*)、the third metal electrode (25*b*)、the second metal electrode (26*a*)、the fourth metal electrode (26*b*) and the inner surfaces of the end through hole (31)、(32).

3. The surface-mount type over-current protection element of claim 1, comprising:

The resistance at room temperature of the overcurrent protection device is less than 5 mΩ.

4. The surface-mount type over-current protection element of claim 1, comprising:

The material of the first insulation layer (23)、the second insulation layer (24) and the third insulation layer (14) is the complex of epoxy rosin and glass fiber.

5. The surface-mount type over-current protection element of claim 1, comprising:

The isolating layer (21) is an epoxy resin layer.

6. The manufacturing method of the surface-mount type over-current protection element of claim 1, comprising:

The first step: Using the crystalline high polymer and the mixture of conductive metal powder and high polymer to manufacture the PTC chip material, and then pasting the metal foil layers on both upper and lower surfaces of the PTC chip material to make the single-layer PTC multiple chips (10)、(10'), whose thickness are 0.35 mm±0.05 mm;

The second step: Putting the third insulation layer (14) between two single-layer PTC multiple chips (10)、(10') and pressing them into one chip, then doing irradiation crosslinking to get the double-layer PTC multiple chip (20);

The third step: There are the etching figures (18)、(19) on the relative position of both the first metal foil layer (11) and the fourth metal foil layer (17), and then cutting the layers according to the figures size to constitute the small multiple chip (30);

The fourth step: Choosing the isolating layer (21) of the same thickness as the small multiple chip (30), and drilling the hole (22) as the corresponding figure of the small multiple chip (30) on the isolating layer (21), then inserting the small multiple chip (30) into the hole (22) of the isolating layer (21) to constitute the covered chip (40);

The fifth step: Bonding the first insulation layer (23) and the second insulation layer (24) on both upper and lower surfaces of the covered chip (40), and then bonding the metal electrodes (25)、(26) on both upper and lower surfaces of the first insulation layer (23) and the second insulation layer (24):

The sixth step: Drilling, including drilling two end through hole (31)、(32) at both the end, drilling the inner through hole (29) through the etching figures (18)、(19), the inner diameter of the inner through hole (29) is shorter than the diameter of the etching figures (18)、(19), drilling the blind holes (27)、(28) on both upper and lower surfaces of the symmetrical position of the inner through hole (29) to expose the first PTC chip material (12) and the second PTC chip material (16);

The seventh stop: Copper plating, including plating copper on surface of the metal electrodes (25)、(26) to be the copper plate (33)、(34), plating copper on the inner surface of the inner through hole (29) and the end through holes (31)、(32) to be the second metallic conductor (37)、the first metallic conductor (38) and the third metallic conductor (39), plating copper on the inner surface of the blind hole (27)、(28) to be the fourth metallic conductor (35) and the fifth metallic conductor (36);

The eighth step: Etching, etching on both upper and lower surfaces of the copper plate (33)、(34) to fall into the left part and the right part, copper plates (33*a*)、(33*b*)、(34*a*) and (34*b*), etching the metal electrodes (25)、(26) to fall into the left part and the right part, the first metal electrode (25*a*)、the third metal electrode (25*b*)、the second metal electrode (25*b*) and the fourth metal electrode (26*b*), to expose the first insulation layer (23) and the second insulation layer (24);

The ninth step: Printing a coat of solder resist ink on both upper and lower surfaces, having solidified to be the fourth insulation layer (41) and the fifth insulation layer (42), the fourth insulation layer (41) insulates the first metal electrode (25*a*) from the third metal electrode (25*b*) and obstructs the portholes of the inner through hole (29) and the blind hole (27), the fifth insulation layer (51) insulates the second metal electrode (26*a*) from the fourth metal electrode(26*b*)and obstructs the portholes of the inner through hole (29) and the blind hole (28);

The tenth step; Plating tin on the surfaces of the first metal electrode (25*a*)、the third metal electrode (25*b*)、the second metal electrode (26*a*)、the fourth metal electrode (26*b*) and the inner surfaces of the end through hole (31)、(32) to be the tin plate to composite the overcurrent protection device (50).

7. The manufacturing method of the surface-mount type over-current protection element of claim 6, comprising:

The first PTC chip material (12) and the second PTC chip material (16) is mixed of polycomponent, including a kind of the crystalline high polymer and a kind of conductive metal powder at least.

8. The manufacturing method of the surface-mount type over-current protection element of claim 7, comprising:

The crystalline high polymer is one of or more of the high density polyethylene、the low density polyethylene、vinyl copolymer、polyvinylidene fluoride; The conductive metal powder is one of or more of nickel powder、cobalt powder、copper powder、silver powder.

9. The manufacturing method of the surface-mount type over-current protection element of claim 6, comprising:

The isolating layer (21) is a single entity, there are many holes (22) on it in equispace to be inserted by the small multiple chip (30), and there are the frameworks between the holes (22), drilling the end through hole on the frameworks, then cutting along the centerline of the frameworks to make many overcurrent protection devices (50).

* * * * *

UNITED STATES PATENT AND TRADEMARK OFFICE

CERTIFICATE OF CORRECTION

PATENT NO. : 8,576,043 B2
APPLICATION NO. : 13/519990
DATED : November 5, 2013
INVENTOR(S) : Zhengping Liu et al.

It is certified that error appears in the above-identified patent and that said Letters Patent is hereby corrected as shown below:

In the Claims

In column 9 at line 40 (claim 6, line 42), “stop” should be --step--.

Signed and Sealed this
Ninth Day of December, 2014

Michelle K. Lee

Michelle K. Lee
*Deputy Director of the United States Patent and Trademark Office*